US009101220B2

(12) United States Patent
Wang

(10) Patent No.: US 9,101,220 B2
(45) Date of Patent: Aug. 11, 2015

(54) SMART SEAT MECHANISM OF AN EXERCISE EQUIPMENT

(71) Applicant: Leao Wang, Taichung (TW)

(72) Inventor: Leao Wang, Taichung (TW)

( * ) Notice: Subject to any disclaimer, the term of this patent is extended or adjusted under 35 U.S.C. 154(b) by 173 days.

(21) Appl. No.: 14/051,425

(22) Filed: Oct. 10, 2013

(65) Prior Publication Data

US 2015/0105227 A1 Apr. 16, 2015

(51) Int. Cl.

| | |
|---|---|
| ***A63B 26/00*** | (2006.01) |
| ***A63B 22/00*** | (2006.01) |
| ***A63B 71/00*** | (2006.01) |
| ***A63B 21/00*** | (2006.01) |
| ***A63B 15/02*** | (2006.01) |
| ***A63B 24/00*** | (2006.01) |
| ***A47C 3/20*** | (2006.01) |
| ***A47C 1/00*** | (2006.01) |

(52) U.S. Cl.

CPC ... *A47C 3/20* (2013.01); *A47C 1/00* (2013.01); *A63B 21/1457* (2013.01); *A63B 22/0046* (2013.01); *A63B 2208/0228* (2013.01)

(58) Field of Classification Search

CPC ..... A63B 21/1457; A63B 21/1461; A63B 21/1465; A63B 22/0046; A63B 22/0087; A63B 22/0089; A63B 24/0087; A63B 2208/0228; A63B 2208/0233; A63B 2225/093; A47C 3/20; A47C 3/24

See application file for complete search history.

(56) References Cited

U.S. PATENT DOCUMENTS

| | | | | |
|---|---|---|---|---|
| 4,387,876 | A * | 6/1983 | Nathan | 248/571 |
| 4,854,641 | A * | 8/1989 | Reineman et al. | 297/344.15 |
| 8,123,664 | B2 * | 2/2012 | Lokken et al. | 482/142 |
| 2009/0233767 | A1 * | 9/2009 | Huang | 482/5 |

* cited by examiner

*Primary Examiner* — Oren Ginsberg

(57) ABSTRACT

A smart seat mechanism of an exercise equipment includes a parallel four-link rod cushion module having a cushion with an electrically adjustable height position, a lead screw, a lift tube, and an electric motor. The smart seat mechanism is operated together with an electronic control panel having a built-in program, so that a user can adjust the height of the cushion freely according to the user's figure and height and the comfort of use. The electric motor is set by the built-in program of the electronic control panel, such that the cushion is descended to the lowest position automatically before/after exercise, to facilitate the user to get on/off the exercise equipment. The electronic control panel is operated with the built-in program and has a plurality of quick memory keys provided for a specific user to adjust the height of the cushion quickly and automatically.

2 Claims, 4 Drawing Sheets

SMART SEAT MECHANISM OF AN EXERCISE EQUIPMENT

BACKGROUND OF THE INVENTION

1. Fields of the Invention

The present invention relates to a smart seat mechanism of an exercise equipment, and more particularly to the smart seat mechanism installed onto any exercise equipment to provide excellent safety and supreme convenience of use.

2. Description of the Related Art

In general, a seat module applied in various exercise equipments such as fitness bikes, rowers, elliptical trainers and steppers is provided for users to sit while doing a specific exercise, and most seat modules come with a design of adjustable height to fit different users and satisfy a minimum basic using requirement.

However, most seat mechanisms of this sort are adjusted manually. In short, the cushion remains at the height that was adjusted by the previous user, so that the next user needs to tune the height repeatedly until the height fits the user. Obviously, it is quite troublesome for users to go through the aforementioned lead operation every time before use.

SUMMARY OF THE INVENTION

Therefore, it is a primary object of the present invention to provide a smart seat mechanism of an exercise equipment, comprising: a parallel four-link rod cushion module capable of electrically adjusting a height position; an electric motor for adjusting a cushion to the best sitting position and using height; particularly, a special design of an electronic control panel and a built-in program thereof for automatically setting the cushion to the lowest height position before/after use to facilitate other users to get on/off the exercise equipment. In the meantime, the electronic control panel has a plurality of quick memory keys provided for a specific user to set a desired height of the cushion quickly and automatically, so as to meet the requirements of practical use and improve the value of practical application.

According to the invention, a smart seat mechanism of an exercise equipment includes a parallel four-link rod cushion module having a cushion with an electrically adjustable height position, a lead screw, a lift tube, and an electric motor. The smart seat mechanism is operated together with an electronic control panel having a built-in program, so that a user can adjust the height of the cushion freely according to the user's figure and height and the comfort of use. The electric motor is set by the built-in program of the electronic control panel, such that the cushion is descended to the lowest position automatically before/after exercise, to facilitate the user to get on/off the exercise equipment. The electronic control panel is operated with the built-in program and has a plurality of quick memory keys provided for a specific user to adjust the height of the cushion quickly and automatically.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show various embodiments of the invention.

Figure 1:
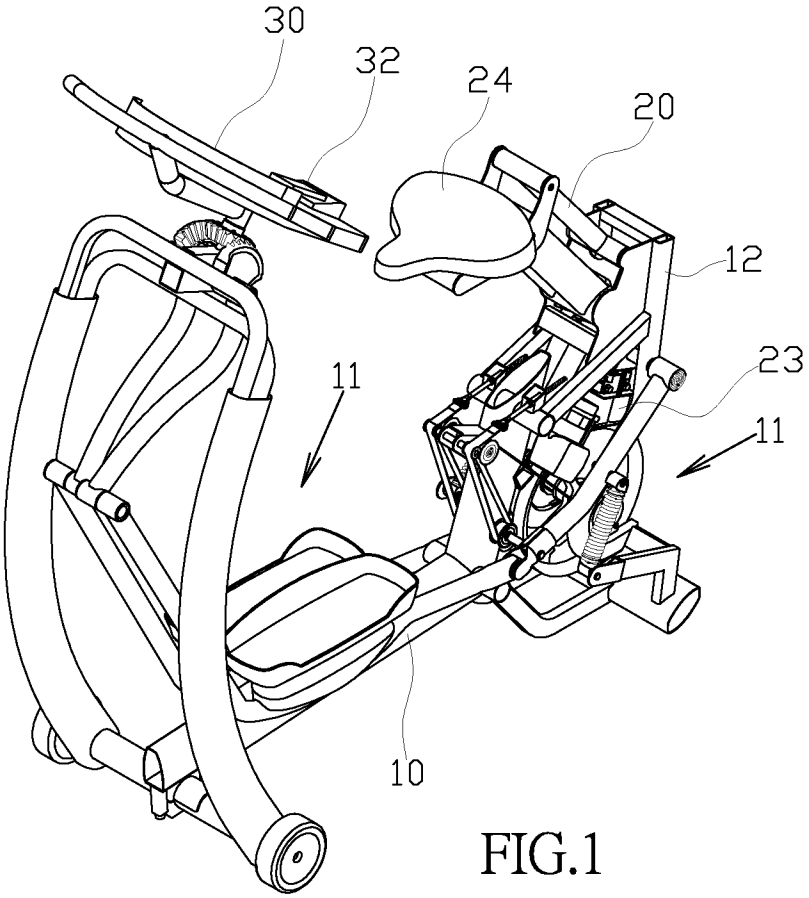
FIG. 1 is a perspective view of a preferred embodiment of the present invention.
Figure 2:
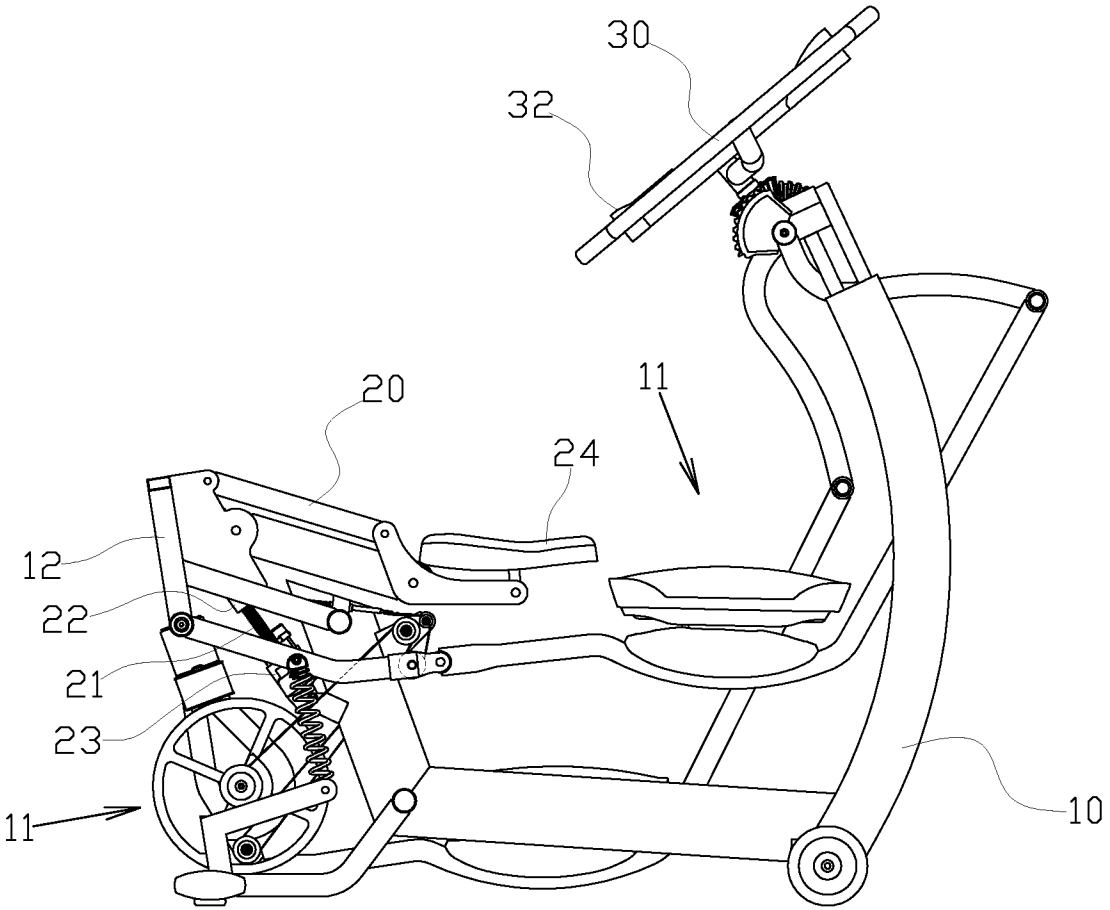
FIG. 2 is a schematic planar view of FIG. 1.
Figure 3:
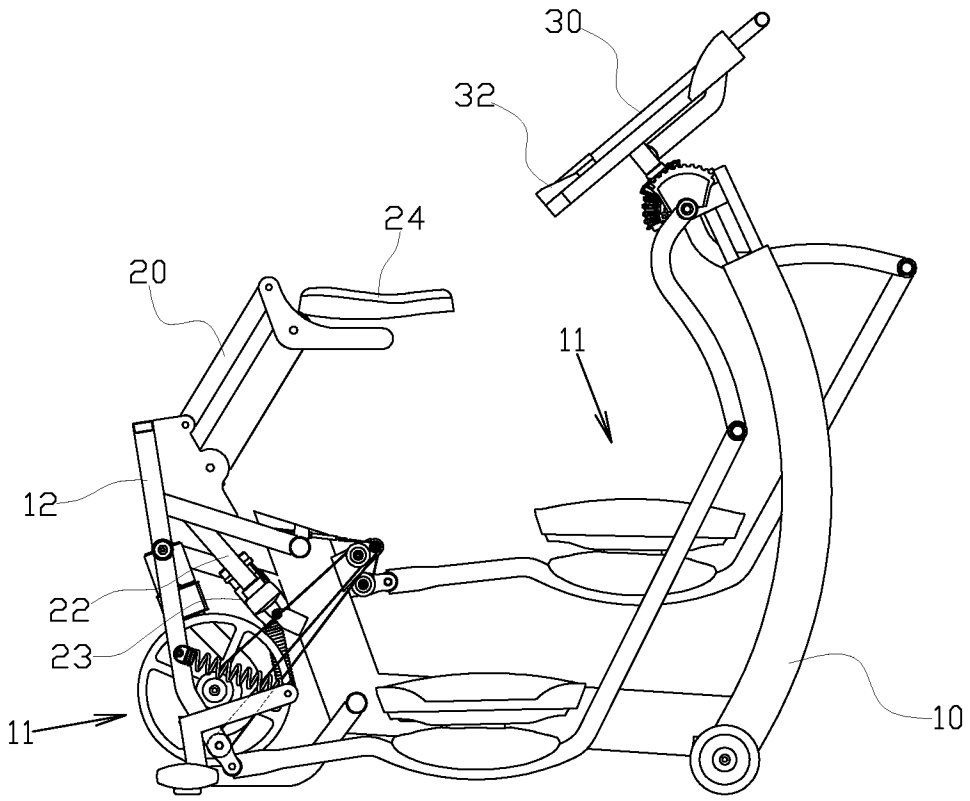
FIG. 3 is a schematic view of a motion (including the adjustment of the height of a cushion) of FIG. 2.

With reference to FIGS. 1 to 3 for a sitting type elliptical exercise equipment 10 (hereinafter referred to as an "exercise equipment") in accordance with a preferred embodiment of the present invention, the exercise equipment 10 comprises a basic exercise mechanism 11, an electronic control panel 30 and a cushion stand 12, and further comprises a parallel four-link rod cushion module 20 having a cushion 24 and capable of electrically adjusting the height position of a cushion stand 12 of the exercise equipment 10, wherein an electric motor 23 having a lead screw 21 and a lift tube 22 is operated together with an electronic control panel 30 having a built-in program, so that the electric motor can be rotated, and the lift tube 22 can be moved vertically up and down with respect to the lead screw 21 (as shown in FIGS. 2 and 3), so as to displace the cushion component 20 and adjust the height of the cushion 24 according to a specific user's figure and height. Particularly, the electric motor 23 can be set by a built-in program of the electronic control panel 30, so that the cushion 24 can be descended automatically to the lowest position (as shown in FIG. 2) before/after exercise to facilitate the user to get on/off the exercise equipment 10. In the meantime, the electronic control panel 30 is operated together with a built-in program and includes a plurality of quick memory keys 32 keys capable of recording the height of a specific user's cushion 24 to facilitate the user to obtain a desired height of the cushion 24 quickly and automatically.

In other words, before a user uses the exercise equipment 10 with the design of the present invention, the cushion 24 is situated at the lowest position, so that the user can get on the exercise equipment 10 easily and can carry out the necessary procedure of electrically adjusting the height of the cushion 24 by a specific adjusting key (not shown in the figure) of the electronic control panel 30. The height of the cushion 24 can be recorded by any one of the quick memory keys 32, so that after a specific user has sat properly, the user simply needs to press the specific quick memory key 32 in order to lift the cushion 24 to the original memory position. Thus, the present invention can meet the requirements of practical use and improve the value of practical application.

The basic exercise mechanism 11 refers a general exercising unit of any specific exercise equipment 10 such as an elliptical machine which is generally a basic exercise mechanism 11 including a pedal link rod, a handrail link rod, a transmission link rod and a transmission flywheel. Since the present invention can be used in various exercise equipments 10 without limiting to any particular exercise equipment and the basic exercise mechanisms 11 for various exercise equipments 10 and assemblies are different, the inventor of the present invention is unable to describe the aforementioned equipments and assemblies one by one in details, therefore a simplified basic exercise mechanism 11 is used for representation.

The principle of driving the so-called "parallel four-link rod mechanism" and "electric motor" is a basic electrical adjusting and control measure and not the technical characteristic of the present invention, and the so-called program control is not claimed, and thus they will not be described.

Figure 4:
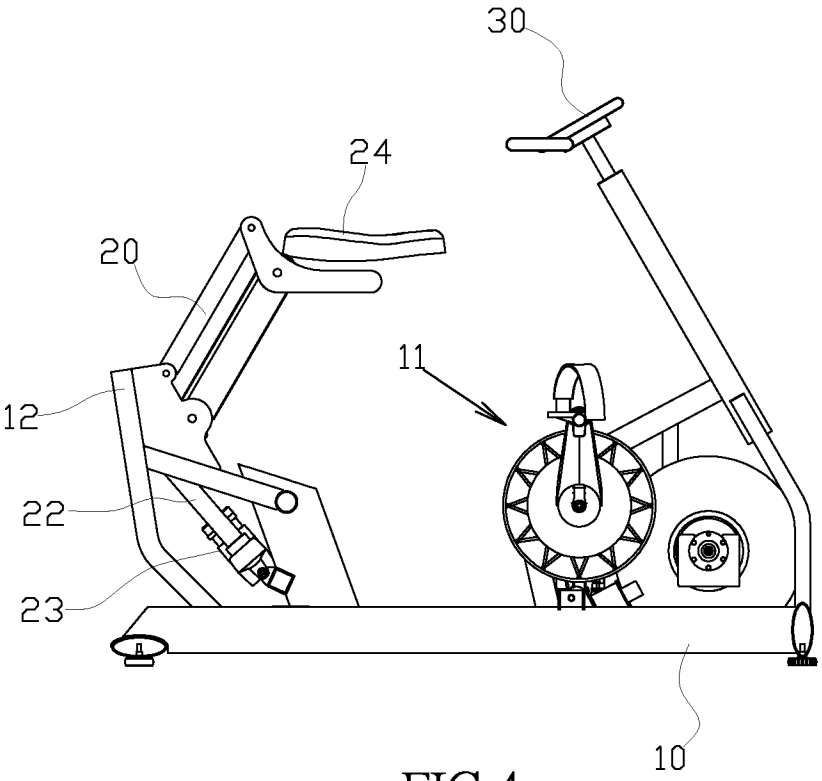
FIG. 4 is a schematic planar view of another preferred embodiment of the present invention.

With reference to FIG. 4 for a schematic view of a fitness bike type exercise equipment 10 in accordance with a preferred embodiment of the present invention, any exercise equipment 10 having a basic exercise mechanism 11, a cushion stand 12 and an electronic control panel 30 can further include a parallel four-link rod cushion module 20, a lead screw 21, a lift tube 22, and an electric motor 23 of the present invention to achieve the desired operating effect and control without any lag. Obviously, the present invention has practical values.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A smart seat mechanism of an exercise equipment, installed onto the exercise equipment, comprising a basic exercise mechanism, an electronic control panel, and a cushion stand with an electrically adjustable height position, and further comprising a parallel four-link rod cushion module of a cushion, a lead screw, a lift tube, and an electric motor, and the smart seat mechanism being mounted onto a cushion stand of the exercise equipment and operated together with the electronic control panel having a built-in program to rotate the electric motor, so that the lift tube can be moved vertically up and down with respect to the lead screw to produce a relative displacement of the cushion module, so as to adjust the height of the cushion, and the electric motor being set by the built-in program of the electronic control panel, so that the cushion can be descended to the lowest position automatically before and after exercise.

2. The smart seat mechanism of an exercise equipment according to claim 1, wherein the electronic control panel operated together with the built-in program includes a plurality of quick memory keys capable of recording the height of the cushion for a specific user.

* * * * *